US005497592A

United States Patent [19]

Boeshart

[11] Patent Number: 5,497,592

[45] Date of Patent: Mar. 12, 1996

[54] QUICK RELEASE TIE

[76] Inventor: Patrick E. Boeshart, P.O. Box 774, Sioux City, Iowa 51102

[21] Appl. No.: 246,326

[22] Filed: May 19, 1994

[51] Int. Cl.[6] ..... E04B 1/38

[52] U.S. Cl. ..... 52/699; 249/43; 52/562

[58] Field of Search ..... 52/698, 699, 700, 52/561, 562, 564; 249/40, 43

[56] References Cited

U.S. PATENT DOCUMENTS

| | | | |
|---|---|---|---|
| 963,776 | 7/1910 | Kosack | 52/426 |
| 994,027 | 5/1911 | O'Beirne | 52/564 |
| 1,126,190 | 1/1915 | Fuehrer | 249/214 |
| 1,488,726 | 4/1924 | Alexander et al. | 249/218 |
| 1,729,807 | 11/1929 | Toogood | 249/216 |
| 1,850,462 | 3/1932 | Kinninger | 249/218 |
| 1,953,287 | 4/1934 | Bemis | 72/44 |
| 1,962,906 | 6/1934 | Mueller | 72/44 |
| 1,994,166 | 3/1935 | Beghetti | 25/131 |
| 2,181,698 | 11/1939 | Langenberg | 72/44 |
| 2,784,476 | 3/1957 | Bergdal | 25/131 |
| 2,794,234 | 6/1957 | White | 25/131 |
| 2,919,572 | 1/1960 | Salzi | 72/48 |
| 3,069,743 | 12/1962 | Luyben | 25/131 |
| 3,625,470 | 12/1971 | Shoemaker | 249/214 |
| 3,734,453 | 5/1973 | Bailey | 249/40 X |
| 3,788,020 | 1/1974 | Gregori | 52/309 |
| 3,905,093 | 9/1975 | Williams | 249/43 X |
| 4,006,878 | 2/1977 | Dawson et al. | 249/43 |
| 4,019,298 | 4/1977 | Johnson, IV | 52/594 |
| 4,180,956 | 1/1980 | Gross | 52/407 |
| 4,233,501 | 9/1980 | DeLozier | 52/309.11 |
| 4,234,156 | 11/1980 | Wepf | 249/40 |
| 4,263,765 | 4/1981 | Maloney | 52/562 |
| 4,300,747 | 11/1981 | Brow | 249/217 |
| 4,416,097 | 11/1983 | Weir | 52/220 |
| 4,439,967 | 4/1984 | Dielenberg | 52/309.12 |
| 4,604,843 | 8/1986 | Ott et al. | 52/426 |
| 4,655,014 | 4/1987 | Krecke | 52/105 |
| 4,698,947 | 10/1987 | McKay | 52/309.12 |

(List continued on next page.)

FOREIGN PATENT DOCUMENTS

| | | | |
|---|---|---|---|
| 283480 | 4/1963 | Australia | 249/40 |
| 193120 | 11/1957 | Austria | 249/218 |
| 263323 | 7/1968 | Austria | 52/562 |
| 542144 | 11/1955 | Belgium | 52/426 |
| 547072 | 10/1957 | Canada | 249/217 |
| 922088 | 3/1973 | Canada | 249/18 |
| 924922 | 4/1973 | Canada | 52/426 |
| 826353 | 12/1952 | Germany | 249/45 |
| 2029175 | 6/1972 | Germany | 52/426 |
| 2310299 | 9/1974 | Germany | 52/562 |
| 2317207 | 10/1974 | Germany | 52/426 |
| 2162560 | 2/1986 | United Kingdom | 249/10 |
| 9229 | 4/1994 | WIPO | 249/40 |

*Primary Examiner*—Creighton Smith
*Attorney, Agent, or Firm*—Zarley, McKee, Thomte, Voorhees & Sease; Mark D. Frederiksen

[57] ABSTRACT

A quick release tie includes an elongated strap having retainer plates removably connected to the opposing ends of the strap. Each retainer plate includes a cylindrical body portion which extends through an aperture in a form panel, a generally flat panel affixed to an outer end of the body portion to prevent movement of the form panel outwardly off of the retainer plate, and a conical inner end tapering to a smaller diameter at the inner end of the body portion. The body portion inner end is interiorly threaded, and selectively engages exterior threads on the opposing ends of the strap to permit selective removal of the retainer plates. A socket formed in an outer surface of the retainer plate panel permits engagement of a tool for rotating the retainer plate so as to engage or disengage the retainer plate from the strap ends. A retainer cup is provided which includes a hollow generally cylindrical wall which tapers from an outer end towards an inner end in a conical shape matching the conical portion of the retainer plate. A projecting flange on the ends of each strap prevents the retainer cup from moving inwardly along the strap, such that the outer end of the retainer cup retains the form panel in engagement with the inner surface of the retainer plate panel.

11 Claims, 3 Drawing Sheets

U.S. PATENT DOCUMENTS

| | | | |
|---|---|---|---|
| 4,706,429 | 11/1987 | Young | 52/309.12 |
| 4,726,560 | 2/1988 | Dotson | 249/43 |
| 4,730,422 | 3/1988 | Young | 52/105 |
| 4,731,968 | 3/1988 | Obino | 52/309 |
| 4,765,109 | 8/1988 | Boeshart | 52/426 |
| 4,884,382 | 12/1989 | Horobin | 52/426 |
| 4,889,310 | 12/1989 | Boeshart | 240/41 |
| 4,894,969 | 1/1990 | Horobin | 52/309.12 |
| 4,916,879 | 4/1990 | Boeshart | 52/426 |
| 4,936,540 | 6/1990 | Boeshart | 249/216 |
| 4,938,449 | 7/1990 | Boeshart | 249/216 |
| 5,140,794 | 8/1992 | Miller | 52/309 |
| 5,209,039 | 5/1993 | Boeshart | 52/699 |

QUICK RELEASE TIE

TECHNICAL FIELD

The present invention relates generally to ties for poured concrete wall systems, and more particularly to an improved tie which permits quick connection and release from the outside of form panels and which will secure a form panel to a completed wall.

BACKGROUND OF THE INVENTION

While wall forming systems have been in use for many years, a recent development in this industry is in the use of rigid polystyrene insulation panels as forms for poured concrete walls. After the concrete has hardened, the panels may be left in place on the walls to serve as permanent insulation, or they may be stripped off to reveal the exposed concrete.

Upon introduction of this new wall forming system, it was found that it was unnecessary to use small "building blocks" to create the forming system for the concrete wall. Rather, larger and larger panels are now being utilized to create the concrete forms. As the panels grew in size, the applicant herein devised new types of ties, such as that described in U.S. Pat. No. 4,765,109, which has special ends that could be "knocked off" to easily remove the large panels from the walls. While that patented tie has proven successful for its intended purpose, there are various instances where a different kind of tie would be more convenient and useful.

One problem with the previous tie design was in situations where a large 4'×8' panel was desired to be used as the forming structure. Because the previous ties were designed to fit in slots in the upper or lower edges, it was not possible to insert a tie intermediate the edges in the panel. Two solutions to this particular problem are disclosed in the inventor's U.S. Pat. Nos. 4,936,540 and 4,938,449, wherein one or both ends have a tie were provided with beveled ends to permit the tie strap to be forced through the polystyrene panel. A removable end piece was then utilized to engage the tie and retain the form panels in position. While these tie designs also proved useful, they still required that portions of the tie be cut away to permit use of the ties in situations where the form panels were to be removed to expose the concrete wall surface.

Another problem with prior art forming systems was in the use of ties which would retain the insulation panel permanently on the wall. Such systems were not capable of use on those occasions where an exposed concrete surface was desired. In such instances, it was necessary to revert to the older methods of wooden forms which could be removed from the wall, but which left markings on the concrete wall which remained after removal of the forms. While the applicant's tie design of U.S. Pat. No. 4,765,109 solved many of these problems in the use of its "knock off ends", those ties could not be utilized in any location other than the edges of the panels. Similarly, the tie designs of U.S. Pat. Nos. 4,936,540 and 4,938,449 utilized reusable end pieces but still required portions of the ties to be cut away in those locations where concrete was to be exposed.

SUMMARY OF THE INVENTION

It is therefore a general object of the present invention to provide an improved tie for use with polystyrene panel forms which permits quick and simple installation and removal of the tie ends to permit selective removal of the insulation form panels.

Another object of the present invention is to provide a quick release tie with removable and reusable end pieces which permit panel removal without projecting tie ends.

A further object is to provide a concrete wall form tie which has a removable end piece for retaining the form panels in position.

Still another object of the present invention is to provide a quick release tie for concrete forms, with retainer pieces for retaining the form panels firmly against the releasable end pieces.

These and other objects of the present invention will be apparent to those skilled in the art.

The quick release tie of the present invention includes an elongated strap having retainer plates removably connected to the opposing ends of the strap. Each retainer plate includes a cylindrical body portion which extends through an aperture in a form panel, a generally flat panel affixed to an outer end of the body portion to prevent movement of the form panel outwardly off of the retainer plate, and a conical inner end tapering to a smaller diameter at the inner end of the body portion. The body portion inner end is interiorly threaded, and selectively engages exterior threads on the opposing ends of the strap to permit selective removal of the retainer plates. A socket formed in an outer surface of the retainer plate panel permits engagement of a tool for rotating the retainer plate so as to engage or disengage the retainer plate from the strap ends. A retainer cup is provided which includes a hollow generally cylindrical wall which tapers from an outer end towards an inner end in a conical shape matching the conical portion of the retainer plate. A projecting flange on the ends of each strap prevents the retainer cup from moving inwardly along the strap, such that the outer end of the retainer cup retains the form panel in engagement with the inner surface of the retainer plate panel.

DESCRIPTION OF THE PREFERRED EMBODIMENT

Figure 1:
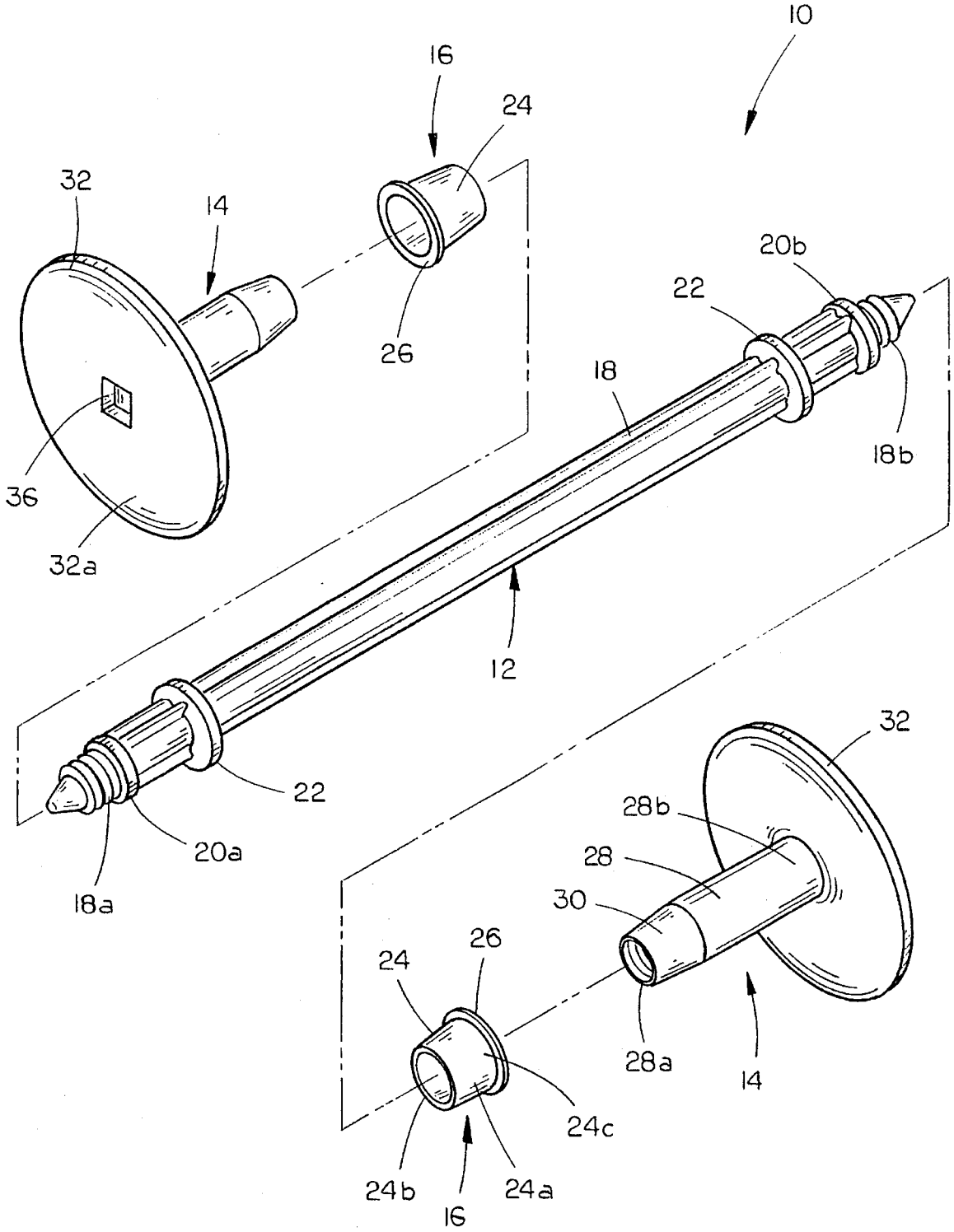
FIG. 1 is an exploded perspective view of the tie of the present invention.

Referring now to the drawings, in which similar or corresponding parts are identified with the same reference numeral, and more particularly to FIG. 1, the tie of the present invention is designated generally at 10 and includes a main body 12 and a pair of opposing retainer plates 14. A retainer cup 16 is utilized in certain locations, as described in more detail hereinbelow.

Main body 12 includes an elongated strap 18 having first and second ends 18*a* and 18*b*. Ends 18*a* and 18*b* are exteriorly threaded to selectively and removably receive retainer plates 14, described hereinbelow. A pair of annular flanges 20*a* and 20*b* are formed on the peripheral surface of strap 18 inwardly of threaded ends 18*a* and 18*b* respectively. Flanges 20*a* and 20*b* project radially outwardly from strap 18 a distance greater than the threaded ends 18*a* and 18*b* to serve as a stop for retainer cups 16. A pair of disks 22 are formed on strap 18 and spaced longitudinally inwardly of flanges 20*a* and 20*b* and generally parallel therewith. Disks 22 serve as locators for reinforcement bar or the like within the poured concrete wall.

Retainer cup 16 includes a generally hollow cylindrical body 24 having a slightly tapered or cone-shaped peripheral wall 24*a* with a rearward end 24*b* and forward end 24*c*. Body 24 is open at the forward and rearward ends 24*c* and 24*b*, and has an interior diameter greater than the diameter of threaded ends 18*a* and 18*b*, and an exterior diameter less than the diameter of flanges 20*a* and 20*b*. Thus, retainer cup 16 is prevented from moving inwardly along strap 18 by flanges 20*a* or 20*b*. An annular lip 26 projects radially outwardly from the forward end 24*c* of body 24, to contact an insulation form panel and retain the form panel in position against the retainer plate 14, as described below.

Each retainer plate 14 includes an elongated body 28 with first and second ends 28*a* and 28*b*. Preferably, body 28 is generally cylindrical, with a conic portion 30 tapering to a smaller diameter at first end 28*a*. Conic portion 30 permits easier removal of retainer plate 14 from a poured concrete wall. First end 28*a* is interiorly threaded so as to selectively engage the threads of strap ends 18*a* or 18*b*.

Figure 3:
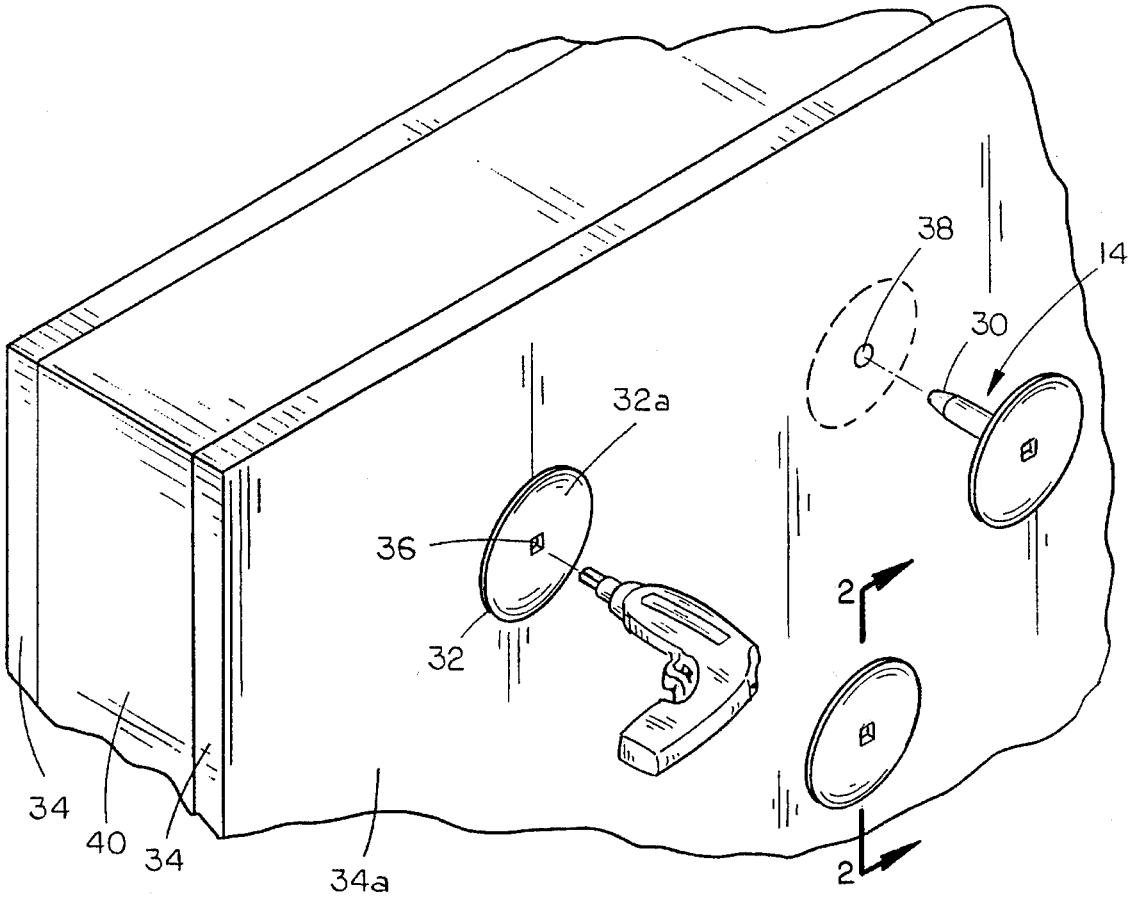
FIG. 3 is a perspective view showing removal of a tie retainer plate.
Figure 2:
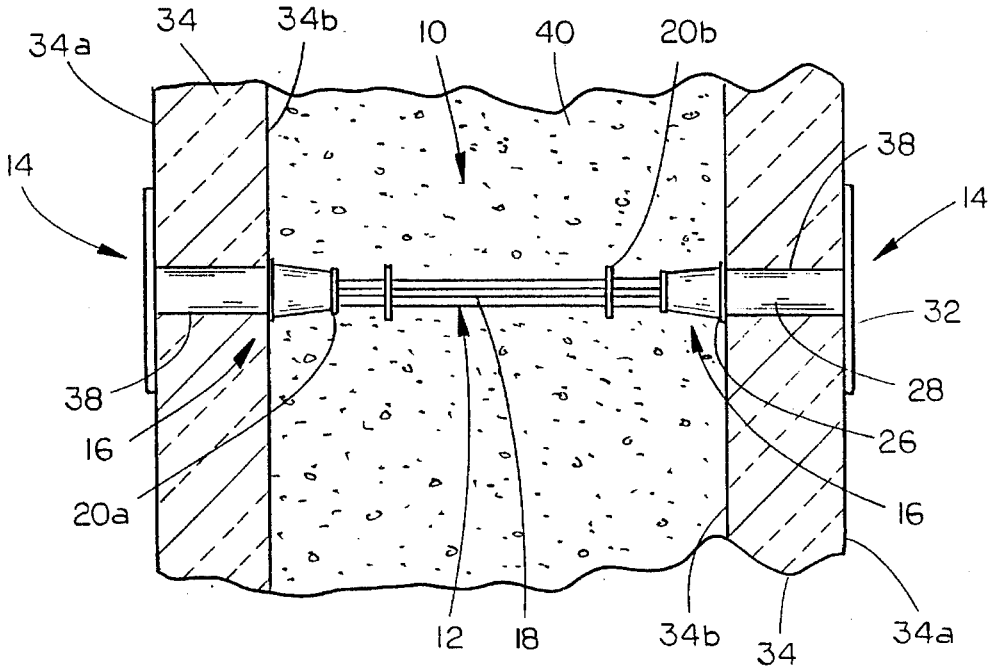
FIG. 2 is a sectional view through a poured concrete wall showing the tie of this invention maintaining form parcels in position.

A flat panel 32 is formed on forward end 28*b* of body 28 and extends in a plane orthogonal to the longitudinal axis of body 28. As shown in FIGS. 2 and 3, panel 32 contacts an outer surface 34*a* of a form panel 34, to prevent outward movement of the form panel 34 along body 28. As shown in FIGS. 1 and 3, panel 32 includes an exterior face 32*a* with a square socket 36 formed centrally therein and dimensioned to receive a conventional socket drive to permit the manual or powered rotation of retainer plate 14 onto the threaded ends 18*a* and 18*b* of main strap 18.

In use, a retainer cup 16 is positioned over ends 18*a* and 18*b* of strap 18 against flanges 20*a* and 20*b*, and then strap 18 is positioned with lips 26 of cups 16 in contact with the inward surfaces 34b of form panels 34, as shown in FIG. 2, with strap 18 aligned with apertures 38 in form panels 34. A retainer plate 14 is journaled into apertures 38 and each inward end 28*a* is threaded onto threaded ends 18*a* and 18*b* of strap 18 so as to retain form panels 34 in position on the ends of tie strap 18.

Because of the tight fit of retainer plate 14 in the aperture 38 of a form panel 34, retainer cups 16 are not always required. Thus, retainer plates 14 may be threaded directly on strap ends 18*a* and 18*b* without the use of a retainer cup 16. Panels 32 prevent outward movement of form panels 34, and friction prevents inward movement of form panels 34 until concrete is poured between the form panels.

Figure 6:
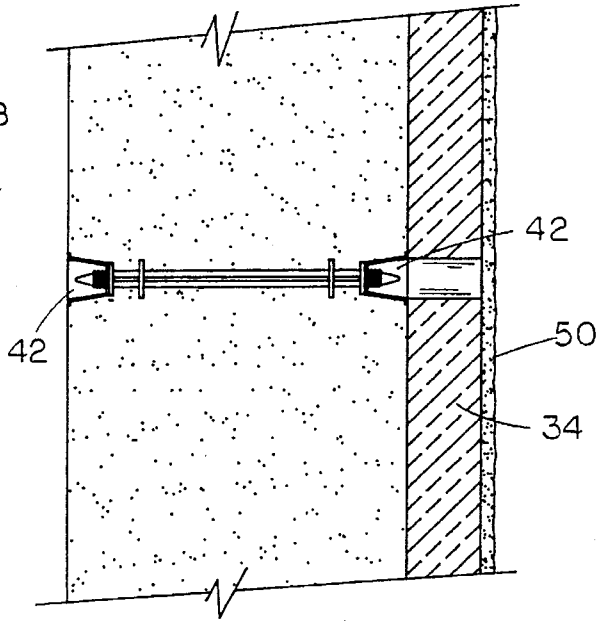
FIG. 6 is a sectional view through a poured concrete wall showing the wall with one exposed concrete surface and the opposite wall surface insulated and finished.
Figure 5:
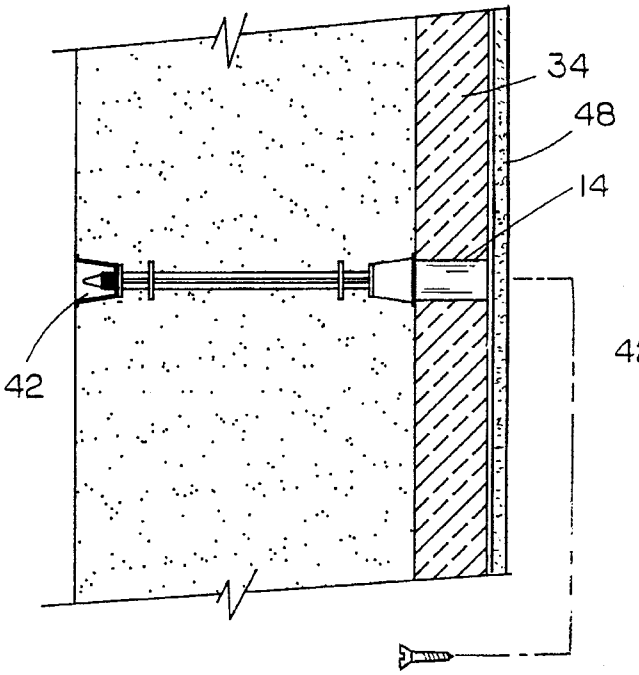
FIG. 5 is a sectional view through a concrete wall showing a wall with one exposed concrete and an opposing insulated surface.
Figure 4:
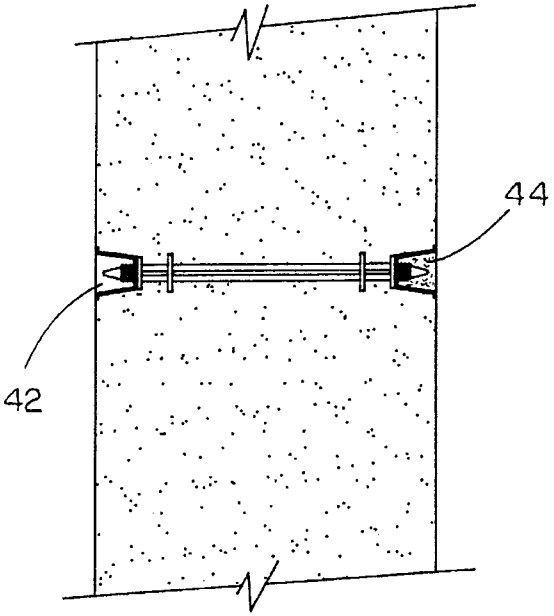
FIG. 4 is a sectional view through a portion of a concrete wall showing the use of the tie of the print invention with a wall having two exposed concrete surfaces.

After the concrete wall 40 has been poured and hardened, there are a number of options available for finishing the wall 40. As shown in FIG. 3, a socket drive may be utilized to remove retainer plates 14 from form panel 34. Because of the tapered conic portion 30 on retainer plate 14, and on retainer cup wall 24, retainer plate 14 and cup 16 may be easily removed from the hardened concrete wall, forming a small cavity 42, as shown in FIGS. 4–6. These cavities 42 may be easily filled flush with the surface of wall 40 with a filler 44, to achieve a clean architectural finish with a minimum of preparation, as shown in FIG. 4.

As an alternative, retainer plates 14 may be left in position to serve as tough, noncorrosive anchors for mechanically fastened finishes, as shown in FIG. 5. Thus, a screw 46 may be mechanically fastened through drywall 48 or the like and directly into retainer plate 14 to fasten drywall 48 in position. Thus, drywall may be applied over an insulated concrete surface.

In another alternative, FIG. 6 shows stucco, plaster, or masonry finishes 50 may be applied directly over the insulated concrete surface.

Whereas the invention has been shown and described in connection with the preferred embodiment thereof, it will be understood that many modifications, substitutions and additions may be made which are within the intended broad scope of the appended claims.

I claim:

1. A tie for interlocking a pair of spaced apart form panels, comprising:

an elongated strap having first and second opposing outer ends;

first means selectively and removably connected to said first end for retaining a first form panel from moving outwardly away from the strap first end; and second means selectively removably connected to said strap second end for retaining a second form panel from moving outwardly away from the strap second end;

said first means for retaining a first form panel from moving outwardly including:

an elongated body portion having first and second ends;

means on the body portion first end for removably connecting the body portion to the first end of the strap; and a generally flat retainer panel mounted on the body portion second end, oriented generally orthogonally to a longitudinal axis of the body portion;

said retainer panel including an inner surface attached to the body portion, and an opposing outer surface;

said retainer panel including means for receiving and engaging a tool, for rotating the panel and body portion about the longitudinal axis of the body portion;

said means for receiving and engaging a tool including a socket formed in the outer surface and aligned coaxial with the body portion longitudinal axis.

2. The tie of claim 1, wherein said body portion is generally cylindrical.

3. The tie of claim 2 wherein said body portion includes a conical portion at the first end which tapers to a smaller diameter at the first end.

4. The tie of claim 2, wherein said means for selectively removably connecting said body portion includes an interiorly threaded aperture in the first end of said body portion, and corresponding exterior threads on the strap first end.

5. The tie of claim 1, further comprising means removably connected to said strap first end for preventing movement of the first form panel inwardly along said strap away from said first means for retaining the form panel from moving outwardly.

6. A tie for interlocking a pair of spaced apart form panels, comprising:

an elongated strap having first and second opposing outer ends;

first means selectively and removably connected to said first end for retaining a first form panel from moving outwardly away from the strap first end;

second means selectively removably connected to said strap second end for retaining a second form panel from moving outwardly away from the strap second end;

said means for preventing movement of the first form panel inwardly including:

a hollow retainer cup with a generally cylindrical wall and first and second ends, said cup having an inner diameter greater than an outer diameter of the strap first end with said strap first end journaled through said cup, and stop means on said strap for preventing longitudinal movement of said cup inwardly beyond a predetermined position; and means removably connected to said strap first end for preventing movement of the first form panel inwardly along said strap away from said first means for retaining the form panel from moving outwardly.

7. The tie of claim 6, wherein said stop means includes an annular flange projecting radially outwardly from said strap.

8. The tie of claim 6, wherein said retainer cup includes an annular lip projecting radially outwardly from the second end of said cup wall.

9. The tie of claim 6, wherein said cup wall is slightly conical, tapering to a smaller diameter from the second end to the first end, said first end in contact with said stop means.

10. A tie for interlocking a pair of spaced apart form panels, comprising:

an elongated strap having first and second opposing outer ends;

first means selectively and removably connected to said first end for retaining a first form panel from moving outwardly away from the strap first end; and second means selectively removably connected to said strap second end for retaining a second form panel from moving outwardly away from the strap second end;

said first means for retaining a first form panel for moving outwardly including:

an elongated, generally cylindrical body portion having first and second ends;

means on the body portion first end for removably connecting the body portion to the first end of the strap; and a generally flat retainer panel mounted on the body portion second end, oriented generally orthogonally to a longitudinal axis of the body portion;

said body portion including a conical portion at the first end which tapers to a smaller diameter at the first end;

said means for preventing movement of the first form panel inwardly including:

a hollow retainer cup with a generally cylindrical wall and first and second ends, said cup having an inner diameter greater than an outer diameter of the strap first end with said strap first end journaled through said cup, and stop means on said strap for preventing longitudinal movement of said cup inwardly beyond a predetermined position.

11. The tie of claim 10, wherein said cup wall is slightly conical, tapering to a smaller diameter from the second end to the first end, said first end in contact with the stop means, and said cup conical shape corresponding with and engaging the conical portion of said body portion when the body portion is connected to the strap first end.

* * * * *